US010139180B2

(12) United States Patent
Schmid et al.

(10) Patent No.: US 10,139,180 B2
(45) Date of Patent: Nov. 27, 2018

(54) GUN LOCK AND FIREARM HAVING SUCH A GUN LOCK

(71) Applicant: L & O Hunting Group GmbH, Isny (DE)

(72) Inventors: Richard Schmid, Obergünzburg (DE); Sergej Popikov, Weitnau (DE)

(73) Assignee: L & O HUNTING GROUP GMBH, Isny (DE)

( * ) Notice: Subject to any disclaimer, the term of this patent is extended or adjusted under 35 U.S.C. 154(b) by 129 days.

(21) Appl. No.: 15/367,772

(22) Filed: Dec. 2, 2016

(65) Prior Publication Data

US 2017/0160033 A1 Jun. 8, 2017

(30) Foreign Application Priority Data

Dec. 4, 2015 (DE) ..... 20 2015 106 612 U

(51) Int. Cl.

| | |
|---|---|
| ***F41A 17/00*** | (2006.01) |
| ***F41A 17/82*** | (2006.01) |
| ***F41A 17/56*** | (2006.01) |
| ***F41A 19/21*** | (2006.01) |
| *F41C 7/00* | (2006.01) |

(52) U.S. Cl.

CPC ..... *F41A 17/82* (2013.01); *F41A 17/56* (2013.01); *F41A 19/21* (2013.01); *F41C 7/00* (2013.01)

(58) Field of Classification Search

CPC ..... F41A 17/82; F41A 19/18; F41A 19/19; F41A 19/21

See application file for complete search history.

(56) References Cited

U.S. PATENT DOCUMENTS 3,537,203 A * 11/1970 Jennie ..... F41A 19/21 42/42.01
3,731,416 A * 5/1973 Semple ..... F41A 19/21 42/42.01

(Continued)

FOREIGN PATENT DOCUMENTS

| | | |
|---|---|---|
| DE | 19749290 A1 | 5/1999 |
| DE | 102004041054 B3 | 3/2006 |
| DE | 102007059097 B3 | 1/2009 |

OTHER PUBLICATIONS

Result of Examination Report for DE 20 2015 106 612.0 filed Dec. 4, 2015 (1 page).

*Primary Examiner* — Gabriel J. Klein
(74) *Attorney, Agent, or Firm* — Paul D. Bianco; Gary S. Winer; Fleit Gibbons Gutman Bongini & Bianco, PL

(57) ABSTRACT

A gun lock of a firearm having two hammers movably disposed on a lock support, a trigger bar for each hammer for holding or releasing the hammers, a trigger, and a disconnector for the trigger, by which disconnector the trigger bars can be moved by the trigger from a holding position into a release position. The disconnector can be moved by an inertial mass between a triggering position, in which the trigger is connected to one of the two trigger bars, and a disconnect position, in which the connection between the trigger and the trigger bars is interrupted. The inertial mass is a pendulum mass swiveling about a transverse axis between a starting position and a safe position, by which the disconnector, upon the release of a first hammer, can be swiveled in a direction opposite to the direction of the pendulum mass into the disconnect position.

14 Claims, 4 Drawing Sheets

(56) References Cited

U.S. PATENT DOCUMENTS

| | | | | | |
|---|---|---|---|---|---|
| 4,403,436 | A | * | 9/1983 | Jennie | F41A 19/21<br>42/42.01 |
| 4,545,143 | A | * | 10/1985 | Schultz | F41A 19/21<br>42/42.01 |
| 4,811,509 | A | * | 3/1989 | Beretta | F41A 19/15<br>42/42.01 |
| 5,074,068 | A | * | 12/1991 | Perazzi | F41A 19/21<br>42/42.01 |
| 5,349,773 | A | * | 9/1994 | Sprangers | F41A 19/14<br>42/42.02 |
| 7,165,350 | B2 | | 1/2007 | Popikow | |

* cited by examiner

GUN LOCK AND FIREARM HAVING SUCH A GUN LOCK

FIELD OF THE DISCLOSURE

The present disclosure relates to a gun lock of a firearm. In addition, the disclosure also relates to a firearm having such a gun lock.

BACKGROUND

DE 10 2007 059 097 B3 discloses a gun lock having two hammers movably disposed on a lock support, a trigger bar dedicated to each hammer for holding or releasing the hammers, a trigger, and a disconnector disposed between the trigger and the trigger bars. The disconnector comprises two intermediate levers arranged parallel to each other, which are swivelably disposed on a main body which can be linearly moved within the lock support. The basic body with the intermediate levers pivotably disposed thereon serves as an inertial mass and, after a first shot has been fired, is displaced in such a manner that a gap is created between the intermediate levers and the trigger bars. Such an interruption of the connection between the intermediate levers and the trigger bars occurs when the firearm, during a rearward movement caused by the recoil, is slowed down by the shoulder of the shooter or rebounds from the shoulder in the forward direction. In addition, disposed inside the main body are locking slides which are associated with the intermediate levers and which are designed to ensure that, during a backward movement of the lock support caused by the recoil, said locking slides, due to their inertia, initially remain in place and come to rest in a forward locked position inside the main body. In this locked position, the intermediate levers are blocked, which prevents an unintended discharge of a second shot even during a recoil-induced backward movement of the lock support. In addition, the trigger also comprises a movable disconnector, which, because of its inertial mass, can be moved relative to the trigger between a rearward actuating position, in which the trigger is connected to the intermediate levers, and a forward disconnect position, in which the trigger is disconnected from the intermediate levers. This ensures that doubling, i.e., the unintended discharge of a second shot after firing the first intended shot, is prevented. However, the design of this prior-art gun lock is relatively complex and comprises a plurality of parts moving relative to each other and coordinated with each other.

SUMMARY

Disclosed are a gun lock and a firearm having such a gun lock which, even though it has fewer parts, ensures a high degree of safety against an unintended discharge of a second shot after the discharge of a first shot.

In the gun lock according to the present disclosure, the inertial mass is a pendulum mass which swivels about a transverse axis between a starting position and a safe position and which allows the disconnector to be swiveled into the disconnect position in a direction opposite to that of the pendulum mass after a first hammer is released. Because of the oppositely directed swivel movement of the pendulum mass and the disconnector, it can be ensured that after the discharge of a first shot, the connection between the trigger and the trigger bars is interrupted both during the acceleration phase and the delay phase, so that a high degree of safety against an unintended discharge of a second shot is ensured. In addition, the design of the disconnector provided with detent means and the pendulum mass as separate components offers the advantage that the generally sensitive detent means of the disconnector do not come into contact with the forward and backward moving pendulum mass and are therefore subjected to lesser stress.

Useful refinements and advantageous embodiments are also disclosed.

To ensure that the pendulum mass and the disconnector swivel in opposite directions, a useful embodiment provides that the pendulum mass comprise, e.g., a lower portion with a lug protruding relative to the axis of rotation so as to rest against a contact surface of the disconnector. The pendulum mass can also comprise a widened upper portion with a recess on the front for receiving the trigger bars.

The disconnector can preferably be controlled by providing the hammers with a control surface that interacts with the contact surfaces of the pendulum mass in such a manner that upon the release of a hammer, the pendulum mass is moved into the safe position and, at the same time, moves the disconnector forward in the opposite direction, into the disconnect position.

In a preferred embodiment, the pendulum mass is mounted in the lock support so as to be able to pivot about the transverse axis, and the disconnector is mounted in a cutout of the trigger so as to be able to pivot about a second transverse axis.

In another useful embodiment, the trigger bars are configured in the form of two-armed levers with an upper arm pointing obliquely upward and a lower arm. On the upper arm of the two trigger bars, a first detent means for engaging a first counter-detent means can be disposed on the top surface of the respective hammer, and on the lower arm of the two trigger bars, a second counter-detent means for engaging a centrally disposed protruding detent means or backwardly offset lateral detent means can be disposed on the back side of the disconnector. The first detent means on the trigger bars can be configured, e.g., in the form of a detent groove, and the associated first counter-detent means on the hammers can be configured in the form of a detent lug. The second counter-detent means on the trigger bars can also be configured in the form of a detent lug, the centrally disposed detent means on the disconnector can be configured in the form of a detent surface on a rearwardly protruding lug, and the lateral detent means can be configured in the form of detent surfaces on lateral cutouts of the disconnector.

In another useful embodiment, an automatic switchover can be implemented in that the disconnector is provided with indentations or recesses for receiving the lug of the trigger bar associated with the released hammer. When the pendulum mass returns to its starting position after a first shot has been fired, it is possible for one of the lateral detent means of the switch [sic] to be positioned under the trigger bar of the not yet released hammer, thereby enabling said trigger bar to be released by actuating the trigger again.

The present disclosure also relates to a double-barreled shotgun or another firearm that is fitted with such a gun lock.

BRIEF DESCRIPTION OF THE DRAWINGS

Additional features and advantages follow from the subsequent description of a preferred embodiment example with reference to the drawings. The figures show.

DETAILED DESCRIPTION

Figure 1:
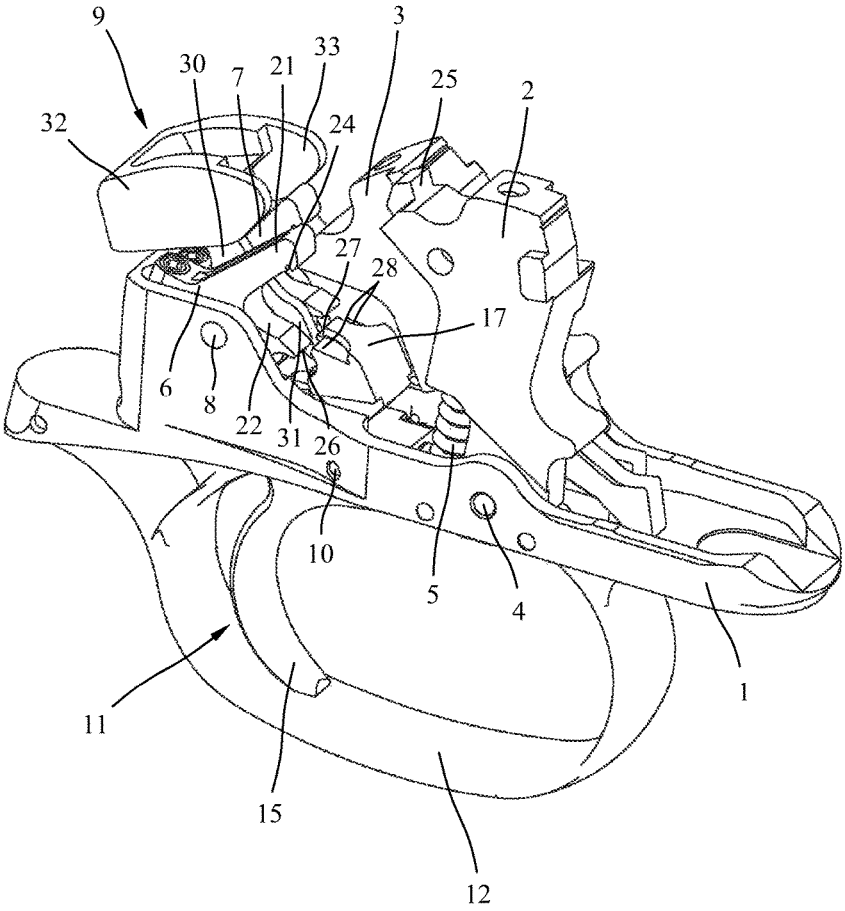
FIG. 1 a perspective view of a gun lock.

The gun lock, shown in FIG. 1 in a perspective view, of a firearm, in particular a shotgun, comprises a lock support 1, also called a lock plate, on which two hammers 2 and 3 arranged side by side are disposed so as to be able to move between a cocked rearward position, as seen when looking in the downrange direction, and a released forward position. The right hammer 2 as seen when looking in the downrange direction, which in the diagram of FIG. 1 is located in the front, is shown to be in a released forward position, and the left hammer 3, as seen when looking in the downrange direction, is shown in a cocked retracted position. Both hammers 2 and 3 are mounted on the lock support 1 so as to be able to pivot about an axis 4 of the hammer. Firing pin springs 5 push the hammers 2 and 3 forward into the released position. The firing pin springs 5 are clamped between the lock support 1 and the respective hammers 2 and 3.

In addition, rearward of the two hammers 2 and 3, as seen when looking in the downrange direction, the lock support 1 also comprises two trigger bars 6 and 7, which are also arranged side by side and which are dedicated to the respective hammers 2 and 3 for the purpose of holding them in the cocked position or releasing them, which trigger bars are disposed so as to be able to pivot about a transverse axis 8. In addition, the lock support 1 also comprises a pendulum mass 9 which is disposed so as to be able to pivot about a transverse axis 8 and which will be described in greater detail below. In addition, the lock support 1 comprises a trigger 11, which is disposed so as to be able to pivot about a trigger axis 10, and a trigger guard 12 on the lower surface of the lock support 1.

Figure 2:
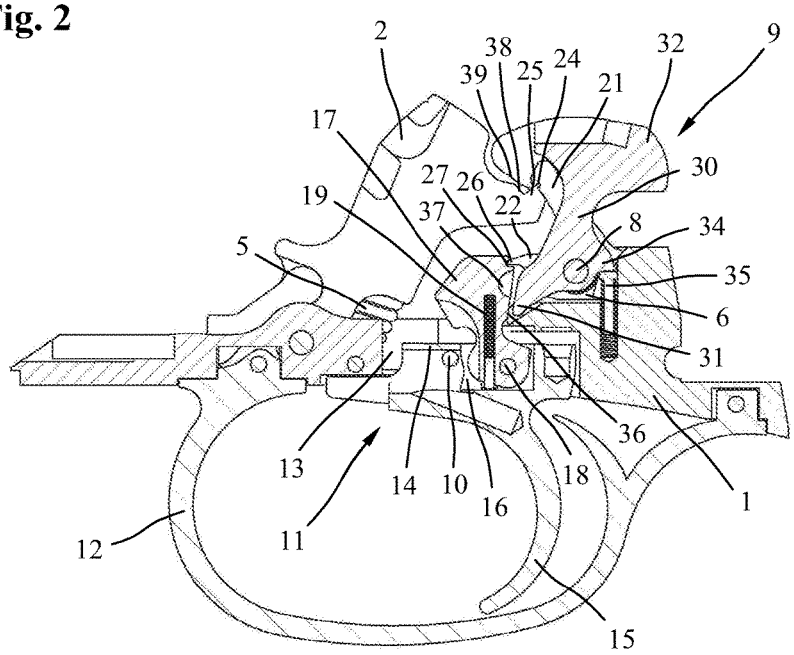
FIG. 2 a longitudinal section through the gun lock shown in FIG. 1 in a cocked position before a first shot is fired.

As indicated by FIG. 2, the trigger 11 comprises a trigger leaf 14 which projects into a recess 13 on the lower surface of the lock support 1 and a trigger tongue 15 protruding downwardly from the lock support 1. In a cutout 16 of the trigger leaf 14, a disconnector 17 configured in the form of an intermediate lever is disposed so as to be able to pivot about a transverse axis 18. The disconnector 17 is pushed rearwardly by a spring 19 which, as seen when looking in the downrange direction, is disposed forward of the transverse axis 18. By means of a trigger sear spring 20 shown in FIG. 4, the trigger 11 is pushed into a forward starting position.

As indicated by FIG. 1, the two identically designed trigger bars 6 and 7 are configured in the form of two-armed levers with an upper arm 21 pointing obliquely upward and a lower arm 22. By means of two spring-loaded compression bolts 23 disposed rearward of the transverse axis 8, as seen when looking in the downrange direction and clearly visible in FIG. 6, pressure is applied to the two trigger bars 6 and 7 in such a manner that the upper arm 21 is pushed downwardly by the spring-loaded compression bolts 23. On the upper arm 21 of the two trigger bars 6 and 7, a first detent means 24 for engaging a first counter-detent means 25 is disposed on the upper surface of the respective hammer 2 and 3. In the embodiment example shown, the first detent means 24 on the trigger bars 6 and 7 is configured in the form of a detent groove and the first counter-detent means 25 on the hammers 2 and 3 is configured in the form of a detent lug. The free end of the lower arm 22 of the two trigger bars 6 and 7 comprises a second counter-detent means 26 for engaging a centrally disposed protruding detent means 27 or backwardly offset lateral detent means 28 on the disconnector 17. In the embodiment example shown, the second counter-detent means 26 on the trigger bars 6 and 7 is configured in the form of a detent lug. The centrally disposed detent means 27 is configured in the form of a detent surface on a rearwardly protruding lug, and the lateral detent means 28 are configured as detent surfaces on lateral cutouts of the disconnector 17.

Figure 4:
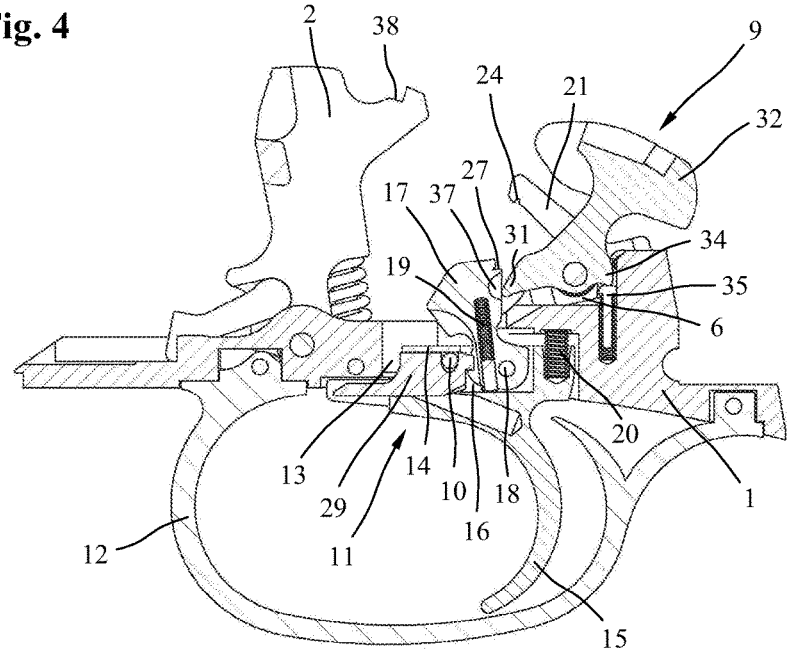
FIG. 4 a longitudinal section through the gun lock shown in FIG. 1 during the release movement of the right hammer as seen when looking in the downrange direction.

By means of a slide 29 shown in FIG. 4, which is disposed on the lower surface of the lock support 1, the disconnector 17 can be moved at right angles to the lock support 1, which allows the centrally disposed detent means 27 on the disconnector 17 to be positioned under the counter-detent means 26 of either the first or the second trigger bar 6 and 7. In this manner, it is possible to determine whether first the right or the left hammer 2 or 3, respectively, is released when the first shot is fired.

As FIGS. 1 and 2 indicate, the pendulum mass 9 comprises a narrow lower portion 30 disposed between the two trigger bars 6 and 7 and having a lug 31 protruding forward relative to the transverse axis 8, as seen when looking in the downrange direction, and an upwardly protruding and widened upper portion 32 with a forward cutout 33 for the arms 21 and 22 of the two trigger bars 6 and 7. In addition, on its narrow lower portion 30, the pendulum mass 9 also comprises a projection 34, as shown in FIG. 2 and disposed rearward of the transverse axis 8, as seen when looking in the downrange direction. The pendulum mass 9 pivots about the transverse axis 8 and can be swiveled between a forward starting position as shown in FIG. 2, and a rearward safe position, as shown in FIG. 4. By means of a spring-loaded compression bolt 35 which is clamped between the lock support 1 and the projection 34, the pendulum mass 9 is pushed forward, as seen when looking in the downrange direction, into its starting position.

The forwardly protruding lug 30 of the pendulum mass 9 is configured in such a manner that, in the starting position shown in FIG. 2, a gap is formed between the lug 31 and the disconnector 17. On the back side facing the lug 31 of the pendulum mass 9, the disconnector 17 comprises a lower stop surface 36 and upper indentations 37.

Disposed on each of the two hammers 2 and 3 is a control surface 38 which interacts with the contact surfaces 39 shown in FIG. 1 on the upper portion 32 of the pendulum mass 9 in such a manner that upon the release of a hammer 2 or 3, the pendulum mass 9 is accelerated rearwardly for movement into a locked position and at the same time moves the disconnector 17 in the opposite direction forward into the disconnect position.

The following discussion will focus on the functionality of the gun lock described above with reference to FIGS. 2 to 6, with FIGS. 2 to 5 illustrating the trigger mechanism with the right hammer 2, as seen when looking in the downrange direction, and with FIG. 6 illustrating the trigger mechanism with both hammers 2 and 3. In FIG. 6, the left hammer 3, as seen when looking in the downrange direction, is released while the other hammer 2 is still in the cocked position.

In FIG. 2, the gun lock with the right hammer 2, as seen when looking in the downrange direction, is shown in the cocked and ready-to-fire position. The pendulum mass 9 is pushed into the triggering position by the spring-loaded compression bolt 35. In the triggering position shown in FIG. 2, the widened upper portion 32 of the pendulum mass 9 is swiveled forward, and a gap is formed between the lug 31 on the lower end of the pendulum mass 9 and the lower stop surface 36 on the disconnector 17. The hammer 2 actuated by the firing pin spring 5 is held in the retracted cocked position by the first detent means 24 on the upper arm 21 of the trigger bar 6, which upper arm is pushed downwardly by the compression bolt 23. The counter-detent means 26 disposed on the lower arm 22 of the trigger bar 6 is engaged from below by the centrally disposed detent means 27 on the disconnector 17.

Figure 3:
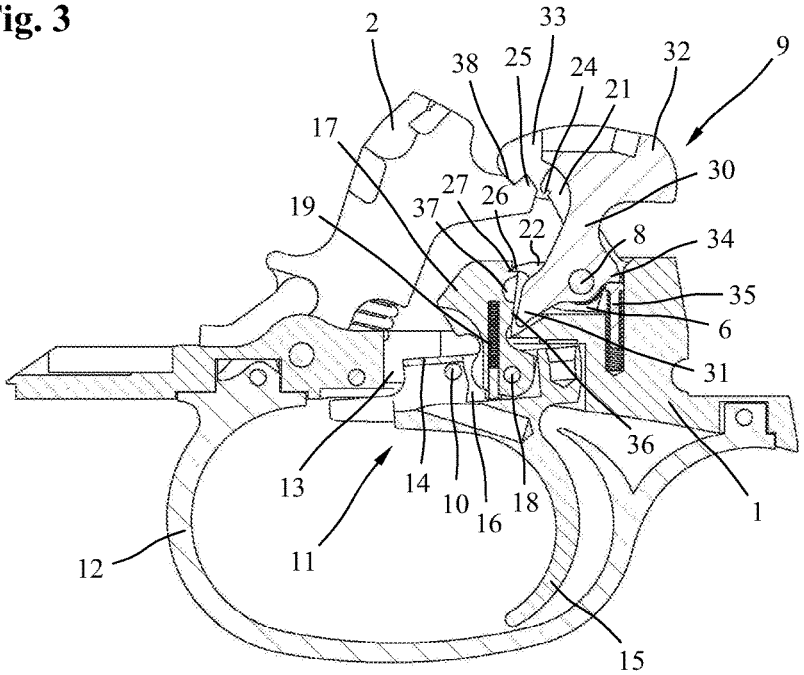
FIG. 3 a longitudinal section through the gun lock shown in FIG. 1 shortly after the release of the right hammer as seen when looking in the downrange direction.

When the trigger 11 is actuated in the position shown in FIG. 1, the disconnector 17 lifts the lower arm 22 of the trigger bar 6, as shown in FIG. 3, which causes the upper arm 21 of the trigger bar 6 to be lifted as well, so that the first detent means 24 of the trigger bar 6 is disengaged from the counter-detent means 25 on the hammer 2, thereby allowing the hammer to be propelled forward by the force of the firing pin spring 5 and to strike the firing pin (not shown) in order to discharge a shot.

As indicated in FIG. 3, when the hammer 2 is released, the control surface 38 disposed on the hammer 2 causes the pendulum mass 9 to swivel rearwardly into a safe position as shown in FIG. 4. At the same time, the lug 31 on the lower end of the pendulum mass 9 comes to rest against the lower stop surface 36 of the disconnector 17 and rotates the disconnector forward, as seen when looking in the downrange direction, against the force of the spring 19, so that the disconnector 17 is disengaged from the second trigger bar 5 [sic], thereby preventing the second trigger bar 5 associated with the second hammer 3 from being actuated by the disconnector 17 and ensuring that a second shot cannot be discharged.

Even if after a shot has been fired, the pendulum mass 9 is moved into the safe position, e.g., as a result of manually resetting or dropping the firearm, as a result of shocks or a rebound of the firearm from the shoulder of the shooter, the disconnector 17 is disengaged from the trigger bars, so that a shot cannot be fired in this phase.

Figure 5:
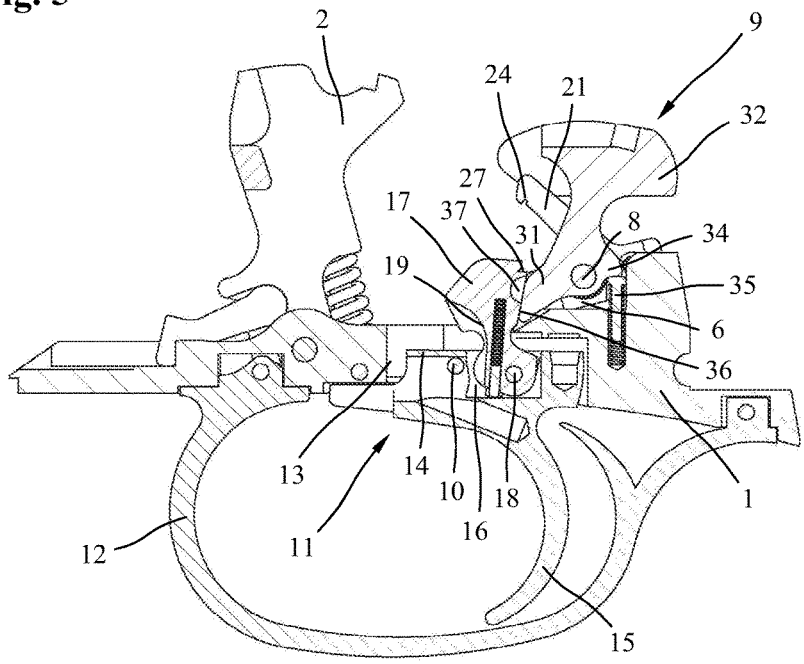
FIG. 5 a longitudinal section through the gun lock shown in FIG. 1 with the right hammer, as seen when looking in the downrange direction, in a released position, and FIG. 6 a partially sectioned lateral view of the gun lock shown in FIG. 1, wherein the left hammer, as seen when looking in the downrange direction, is released and the switchover for firing a second shot has been completed.
Figure 6:
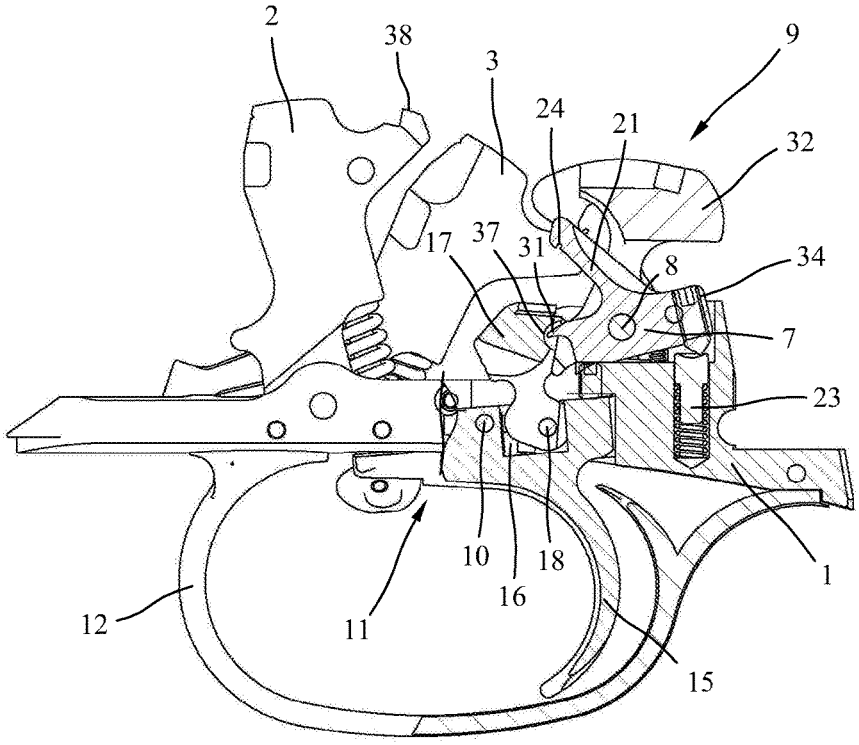

Only when, after the discharge of a first shot, the pendulum mass 9 has returned to its starting position shown in FIG. 5 is it possible for the disconnector 17 to return to its triggering position. At the same time, the lug 31 of the trigger bar associated with the released hammer can engage in the respective indentation 37 on back side of the interrupter 17. In FIG. 6, this is illustrated for a position in which the left hammer 2, as seen when looking in the downrange direction, is released while the right hammer 3 is still in a cocked position. When, after the release of the first hammer 2, the pendulum mass 9 has returned from the safe position to the starting position and the disconnector 17 has moved in the opposite direction from the disconnect position into a triggering position, the lug 31 of the trigger bar 7 associated with the released hammer 2 can engage in the respective indentation 37 on the back side of the disconnector 17, thereby allowing one of the lateral detent means 28 of the disconnector 17 to engage the lug 31 of the trigger bar 6 associated with the other hammer 3 from below. Only by re-actuating the trigger 11 is it possible for the trigger bar 6 to be rotated by the disconnector 17 to a position that allows the release of the second hammer 3.

LIST OF REFERENCE CHARACTERS

1 Lock support
2 Hammer
3 Hammer
4 Axis of the hammer
5 Firing pin spring
6 Trigger bar
7 Trigger bar
8 Transverse axis
9 Pendulum mass
10 Trigger axis
11 Trigger
12 Trigger guard
13 Recess
14 Trigger leaf
15 Trigger tongue
16 Cutout
17 Disconnector
18 Transverse axis
19 Spring
20 Trigger sear spring
21 Upper arm
22 Lower arm
23 Compression bolt
24 First detent means
25 First counter-detent means
26 Second counter-detent means
27 Centrally disposed detent means
28 Lateral detent means
29 Slide
30 Narrow lower portion
31 Lug
32 Widened upper portion
33 Cutout
34 Projection
35 Compression bolt
36 Lower stop surface
37 Upper indentation
38 Control surface
39 Contact surface

The invention claimed is:

1. A gun lock of a firearm having two hammers movably mounted on a lock support, a trigger bar dedicated to each hammer for holding or releasing the hammers, a trigger, and a disconnector dedicated to the trigger, by which disconnector the trigger bars are moveable by the trigger from a holding position into a release position, wherein the disconnector is moveable by an inertial mass between a triggering position, in which the trigger is connected to one of the two trigger bars, and a disconnect position, in which the connection between the trigger and the trigger bars is interrupted, wherein the inertial mass is a pendulum mass which swivels about a transverse axis between a starting position and a safe position and by which the disconnector, upon release of a first hammer, can be swiveled in a direction opposite to the direction of the pendulum mass into the disconnect position and wherein the hammers comprise a control surface which interact with contact surfaces of the pendulum mass such that upon release of one of the two hammers, the pendulum mass is moved into the safe position and at the same time moves the disconnector in the opposite direction forward into the disconnect position.

2. The gun lock of claim 1, wherein the pendulum mass comprises a lower portion with a lug protruding relative to the axis of rotation which, during the movement of the pendulum mass into the safe position, comes to rest against a stop surface of the disconnector.

3. The gun lock of claim 2, wherein on a back side of the disconnector, the disconnector comprises indentations for receiving the lug of the trigger bar associated with the released hammer.

4. The gun lock of claim 1, wherein the pendulum mass is disposed on the lock support so as to be pivotable about the transverse axis and the disconnector is disposed in a cutout of the trigger so as to be pivotable about a second transverse axis.

5. The gun lock of claim 1, wherein the trigger bars are configured in the form of two-armed levers with an upper arm pointing obliquely upward and a lower arm.

6. The gun lock of claim 1, wherein the pendulum mass comprises a widened upper portion with a cutout in front for receiving the trigger bars.

7. The gun lock of claim 1, wherein the pendulum mass is pushed into a forward starting position by a spring-loaded compression bolt.

8. The gun lock of claim 1, wherein the disconnector is pushed into the triggering position by a spring.

9. The gun lock of claim 1, wherein the trigger bars are pushed into the holding position by a spring-loaded compression bolt.

10. A firearm with the gun lock of claim 1.

11. A gun lock of a firearm having two hammers movably mounted on a lock support, a trigger bar dedicated to each hammer for holding or releasing the hammers, a trigger, and a disconnector dedicated to the trigger, by which disconnector the trigger bars are moveable by the trigger from a holding position into a release position, wherein the trigger bars are configured in the form of two-armed levers with an upper arm pointing obliquely upward and a lower arm, wherein the disconnector is moveable by an inertial mass between a triggering position, in which the trigger is connected to one of the two trigger bars, and a disconnect position, in which the connection between the trigger and the trigger bars is interrupted, wherein the inertial mass is a pendulum mass which swivels about a transverse axis between a starting position and a safe position and by which the disconnector, upon release of a first hammer, can be swiveled in a direction opposite to the direction of the pendulum mass into the disconnect position, wherein on the upper arm of the two trigger bars, a first detent for engaging a first counter-detent is disposed on the upper surface of the respective hammers, and wherein on the lower arm of the two trigger bars, a second counter-detent for engaging a centrally disposed protruding detent or backwardly offset lateral detent are disposed on the back surface of the disconnector.

12. The gun lock of claim 11, wherein the first detent on the trigger bars is configured in the form of a detent groove and the first counter-detent on the hammers is configured in the form of a detent lug.

13. The gun lock of claim 11, wherein the second counter-detent on the trigger bars is configured in the form of a detent lug, the centrally disposed detent on the disconnector is configured in the form of a detent surface on a rearwardly protruding lug, and the lateral detent are configured in the form of detent surfaces on lateral cutouts of the disconnector.

14. A firearm with the gun lock of claim 11.

* * * * *